US006183264B1

(12) United States Patent
Harsányi

(10) Patent No.: US 6,183,264 B1
(45) Date of Patent: Feb. 6, 2001

(54) SAFETY RECEPTACLE FOR ELECTRICAL OUTLETS

(76) Inventor: Eduardo G. Harsányi, Calle 8 N° 835-4" piso - Of. 3, La Plata (1900) - Pcia. Bs. As. (AR)

( * ) Notice: Under 35 U.S.C. 154(b), the term of this patent shall be extended for 0 days.

(21) Appl. No.: 09/356,605

(22) Filed: Jul. 19, 1999

(51) Int. Cl.[7] ..... H01R 11/30
(52) U.S. Cl. ..... 439/38; 438/39
(58) Field of Search ..... 439/38, 39, 40, 439/700, 180, 188

(56) References Cited

U.S. PATENT DOCUMENTS

| | | | |
|---|---|---|---|
| 2,385,620 | 9/1945 | Fleckenstein | 177/311 |
| 2,573,920 | 11/1951 | McLeod | 200/51.09 |
| 2,596,166 | 5/1952 | Peterson | 313/318 |
| 3,297,886 | 1/1967 | Danner | 307/112 |
| 3,868,160 | 2/1975 | Kersman | 339/12 R |
| 4,242,657 | 12/1980 | Chaillot | 335/207 |
| 4,317,969 | 3/1982 | Riegler | 200/52 |
| 5,700,157 | 12/1997 | Chung | 439/490 |

*Primary Examiner*—Paula Bradley
*Assistant Examiner*—Alexander Gilman
(74) *Attorney, Agent, or Firm*—William B. Ritchie

(57) ABSTRACT

A safety outlet receptacle with a corresponding plug that renders the outlet receptacle inactive and unable to transmit an electrical current unless activated using the corresponding plug. The invention uses a very simple magnetic switch that is biased with a spring to change the activity state of the outlet receptacle. A single matched magnet and ferromagnetic base is used to activate the magnetic switch. The invention can be used to replace any type of standard outlet receptacle regardless of the electrical power that is being utilized such as 110 or 220 volt, 50 or 60 cycle, AC or DC. The invention also features an indicator light in order for a user to be certain that the outlet receptacle needs to be replaced because it is no longer operating in a safe manner.

10 Claims, 5 Drawing Sheets

SAFETY RECEPTACLE FOR ELECTRICAL OUTLETS

BACKGROUND OF THE INVENTION

1. Field of the Invention

The present invention relates to a safety electrical receptacle for installation into a standard electrical outlet box, in particular, a safety electrical receptacle utilizing a magnetic switch.

2. Description of the Related Art

Child safety is an ever-present concern to families and the public at large. Electrical outlets in the home as well as any environment to which children and any adult who may be mentally impaired are likely to encounter present a serious danger. Items that are electrically conductive, such as pins, scissors, needles or other pointed objects, have been inserted into 'live' electrical wall outlets causing serious if not fatal electrocution. This danger from electrocution is especially great in countries or in places where 220 volts is being used. In other instances, in both commercial and industrial settings, improper maintenance or care of electrical outlets have caused electrocution.

In response to this problem, numerous attempts have been made to prevent such occurrences. Devices have been made to obstruct the electrical connection ports so that foreign objects cannot be inserted. However, in order to make the outlet receptacle useful, such devices must be reasonably easy to remove or the outlet receptacle cannot be used. Therefore, the safety provided by this type of device is limited to very young children or others who cannot remove the device from the outlet connection port.

However, either through repeated use or time, the devices either fail to operate properly or can be easily removed by hand and, therefore, are not absolutely "childproof" even for very young children or substantially impaired adults.

Other more complex attempts have been made to deactivate the outlet receptacle if it is not being properly used. Many of these devices use various configurations of a magnetic switch in order to deactivate the outlet receptacle.

U.S. Pat. No. 4,242,657, issued to Chaillot on Dec. 30, 1980, discloses two matched pairs of a magnet and a ferro-magnetic material member that is attracted by a magnet but retains little magnetism once the magnet is removed such a soft iron. One pair is used to bias the device in an inactive state so that the electrical connection ports are not alive. A second pair having a magnet substantially stronger than the magnet in the first pair is used to activate the outlet receptacle when a plug is inserted therein. The permanent magnet is attached to the plug and the attractable material is attached to outlet receptacle. This arrangement is expensive to produce and requires that the magnets be precisely calibrated in order for the device to function.

U.S. Pat. No. 4,317,969, issued to Riegler et al. On Mar. 2, 1982, discloses an electrical line connector. This design also features two magnets. A biasing spring is used to hold the distributor part in an inactive state. A permanent magnet affixed to the collector port attracts a holding magnet which causes the distributor part to become active. A contact plate is disposed between the two magnets. This device is also expensive to produce and cannot be used as a replacement for standard outlet receptacles and standard plugs.

Still another variation is disclosed by Kersman in U.S. Pat. No. 3,868,160, issued on Feb. 25, 1975. This design features a flexible member having a contact adjacent to each end with the flexible member being connected to a magnet or ferro-magnetic material nearer to one end of the flexible member than to the other end. The flexible member is biased so that it is bent such that the two contacts do not activate the outlet receptacle. A corresponding permanent magnet in the plug causes the flexible member to activate the outlet receptacle once the plug is inserted into the outlet receptacle. The device is dependent on the critically adjusting the ease of flexing the flexible member in comparison with the magnetic force provided by the magnet.

The above described devices do not meet the requirement of a simple to build, magnetically operated switch within a plug/outlet receptacle that can be used within any standard sized outlet box or with any electrical system configuration.

SUMMARY OF THE INVENTION

It is an aspect of the invention to provide a safety receptacle that prevents a child or an impaired adult from receiving a shock by placing a foreign object into one or more of the electrical connection ports of an outlet receptacle.

Another aspect of the invention is to provide a safety receptacle that is simple and inexpensive to make and can be easily installed in any household or commercial setting and used with standard outlet boxes.

Another aspect of the invention is to provide a safety receptacle that is only electrically active when a specially adapted companion plug is inserted into the outlet receptacle.

Still another aspect of the invention is to provide a safety receptacle that requires only a single matched pair of magnets or a single matched pair of a magnet and a ferro-magnetic material member.

Another aspect of the invention is to provide a safety receptacle that has a spring biased piston that activates or deactivates the safety receptacle.

Still another aspect of the invention is to provide a safety receptacle that can be used with all currently used voltage, amperages, and cycles combinations.

Finally, it is another aspect of the invention to provide a safety receptacle that provides a visual indicator that indicates if the safety receptacle is not functioning safely.

The invention is a safety apparatus for selectively placing an electric outlet either in an active or an inactive position. An outlet receptacle is provided that has at least two electrical connection ports. At least two electrical feeds are also provided. Each one of the electrical connection ports corresponds to one of the electrical feeds. At least one of the feeds being designated as "hot", that is, electric current will flow if the feed is connected to a ground. The feeds connect the outlet receptacle to an electrical system such as the 110-volt, 60 cycle AC which is typically used in United States residences. A slideable piston is mounted within the outlet receptacle. The piston has a contact end and an activation end. At least one contact is attached to the contact end of the slideable piston and is in electrical communication with hot feed. A compression spring is positioned around said slideable piston and is used for biasing said piston. An outlet plug is provided that has a mounting surface. The outlet plug also has at least two electrical pins protruding substantially perpendicular from the mounting surface. The electrical pins correspond to the electrical connection ports of the outlet receptacle. The electrical pins of the outlet plug and the corresponding electrical connection ports of the outlet receptacle are aligned so that the outlet plug can be inserted into the outlet receptacle. A magnet member is provided. A matching member made from a ferro-magnetic material capable of being attracted by the magnet is also provided. The magnet and its corresponding matching member define a single matched pair. One member of the matched pair is mounted on the mounting surface of the outlet plug. The other member of the matched pair is mounted on the activation end of the slideable piston. The magnet and its matching member are aligned such that when said outlet plug is inserted into said outlet receptacle, the matched pair is immediately adjacent to one another. If the outlet plug is out of the outlet receptacle, the spring biases the slideable piston causing the at least one contact to be disengaged from its corresponding electrical connection port. This places the outlet receptacle in the inactive state. This results in at least the hot feed of the outlet receptacle to be isolated from the corresponding electrical connection port. In this manner, the outlet receptacle is unable to transmit an electrical current. When the plug is inserted into the receptacle, the matched pair are attracted toward one another resulting in said slideable piston sliding to cause the contact to be releasable connected to its corresponding electrical connection port. This provides the active state; that is, the outlet receptacle is able to transmit an electrical current.

DETAILED DESCRIPTION OF THE INVENTION

The invention is a safety device having two basic components: an outlet receptacle and a corresponding plug. The invention can be used to replace any currently used outlet receptacle for any presently used electrical power system, such as 110 or 220, 50 or 60 cycle, AC or DC. The invention can easily be modified to accommodate any particular electrical connection port/pin combination such as two connectors, two connectors with a ground, round connectors, angled connectors and others well known in the art.

Figure 1:
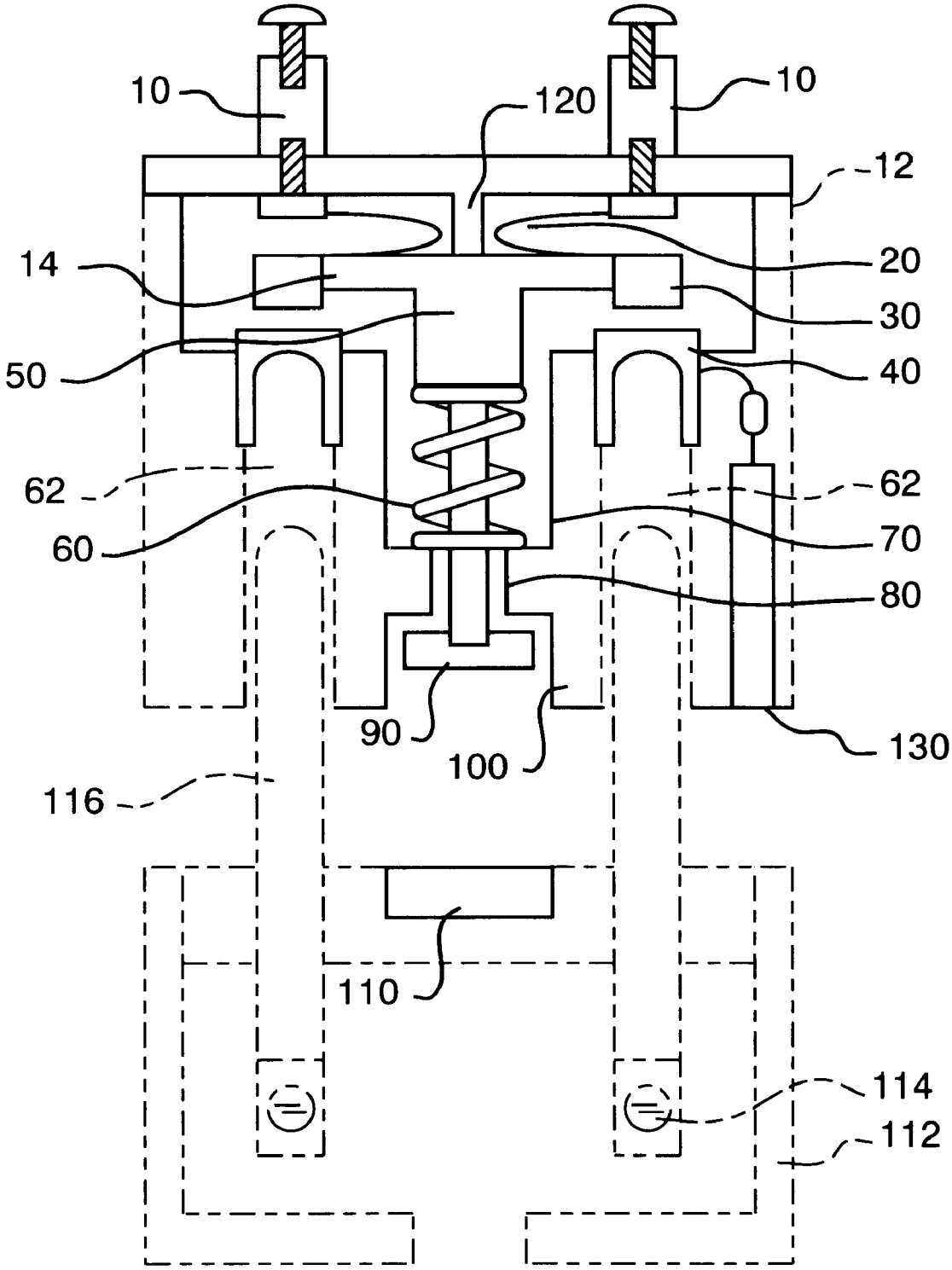
FIG. 1 is a side cutaway schematic view of the invention showing the receptacle in a non-active state.

Referring now to FIG. 1, the invention is a combination safety outlet receptacle and corresponding outlet plug. The receptacle is designed to be universally adaptable to any type of outlet plug configuration that is well known in the art. The invention, if placed in the inactive states, will not transmit a current flow to the electrical connection ports 40 of the outlet receptacle 12 because line feeds 10 are disconnected from ports 40 via contacts 30. Contacts 30 are connected to feeds 10 via flexible metallic mesh or chain 20. Contacts 30 are preferably located at either end of insulating arms 14 which are substantially perpendicular to insulating piston 50. Compression spring 60, which surrounds a portion of insulating piston 50 serves to bias piston 50 such that outlet receptacle 12 is in an inactive state if outlet plug 112 is not completely inserted into outlet receptacle 12 as shown in FIG. 1. Outlet plug 112 is electrically connected to outlet receptacle 12 by inserting pins 116 into sockets 62 such that pins 116 are in contact with electrical connection ports 40. Pins 116 are wired to whatever unit is to receive electrical power by attaching a power cord to pins 116 via screws 114 or any other suitable attachment method well known in the art. Piston 50 is free to travel within cylinder 70 having two limits of travel. The upper limit of travel of piston 50 is when piston 50 contacts 120 which defines the inactive state since, as shown, contacts 30 are displaced away from electrical connection ports 30. Note that when in the inactive state, a child or an impaired adult can place a nail, a hair pin or other material into one or both of the electrical connection ports 40 and not receive a shock since there is no electrical current being supplied to electrical connection ports 40.

The lower limit of travel of piston 50 is determined when contacts 30 are firmly urged against electrical connection ports 40. Anterior section 80 also serves to limit the travel of piston 50. At the lower end of piston 50 is a substantially rectangular metallic base 90 that is made up of ferro-magnetic material that retains little magnetism once base 90 has been removed from the influence of a magnet. Base 90 is positioned within a corresponding rectangular recess 100 which serves to prevent piston 50 from rotating which would disrupt the alignment between contacts 30 and electrical connection ports 40. Indicator light 130 is wired between the two electrical connection ports or between the hot feed and a ground so that if the outlet receptacle 12 is live, indicator light 130 will be lit. In this manner, it can readily determined at a glance whether the outlet receptacle is functioning properly or whether it needs to be replaced. While indicator light 130 is shown in the right side of one of the sockets 62, inidicator light 130 can be placed anywhere on the surface of outlet receptacle as required.

Figure 2:
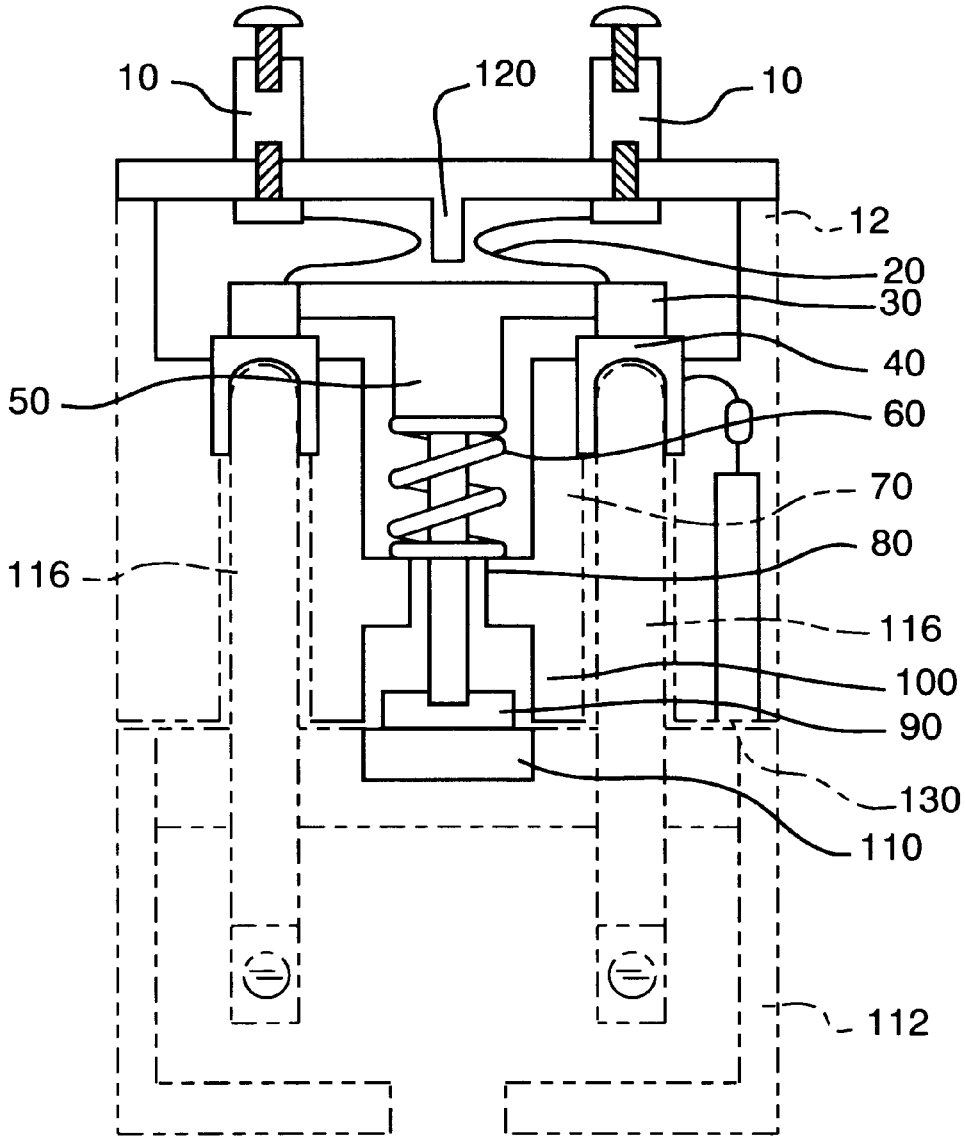
FIG. 2 is a side cutaway schematic view of the invention showing the receptacle in an activated state.

Referring now to FIG. 2, it will now be shown how the invention is changed into the active state so that a device can receive electrical power by being plugged into electrical outlet 12. In this configuration plug 112 has been inserted into outlet receptacle 12 so that pins 116 are urged against electrical connection ports 40. Magnet 110, being immediately adjacent to magnetic material 90 causes piston 50 to move toward plug 112. The force of the magnetic attraction between magnet 110 and its matching ferro-magnet material 90 is sufficient to overcome the force necessary to compress spring 60. Once piston 50 slides toward plug 112, contacts 30 are urged against electrical connection ports 40 and outlet receptacle 12 is able to provide electrical power to whatever device has been plugged into it.

Note that magnet 110 and ferro-magnetic material 90 could be reversed. Magnet 110 could be position on pistoned 50 and ferro-magnetic material 90 could be placed on plug 112 and the invention would still work as intended. Also note that two matching magnets could be used providing the poles of the respective magnets were aligned properly rather than using one magnet and ferro-magnetic material and the invention would still achieve its objectives. While a permanent magnet is preferable due to the lower cost of manufacture, an electromagnet could also be used.

Once the plug is removed, the magnetic attraction is broken, and spring 60 causes piston 50 to slide away towards stop 120 and outlet receptacle 12 is again placed in an inactive state.

Figure 3:
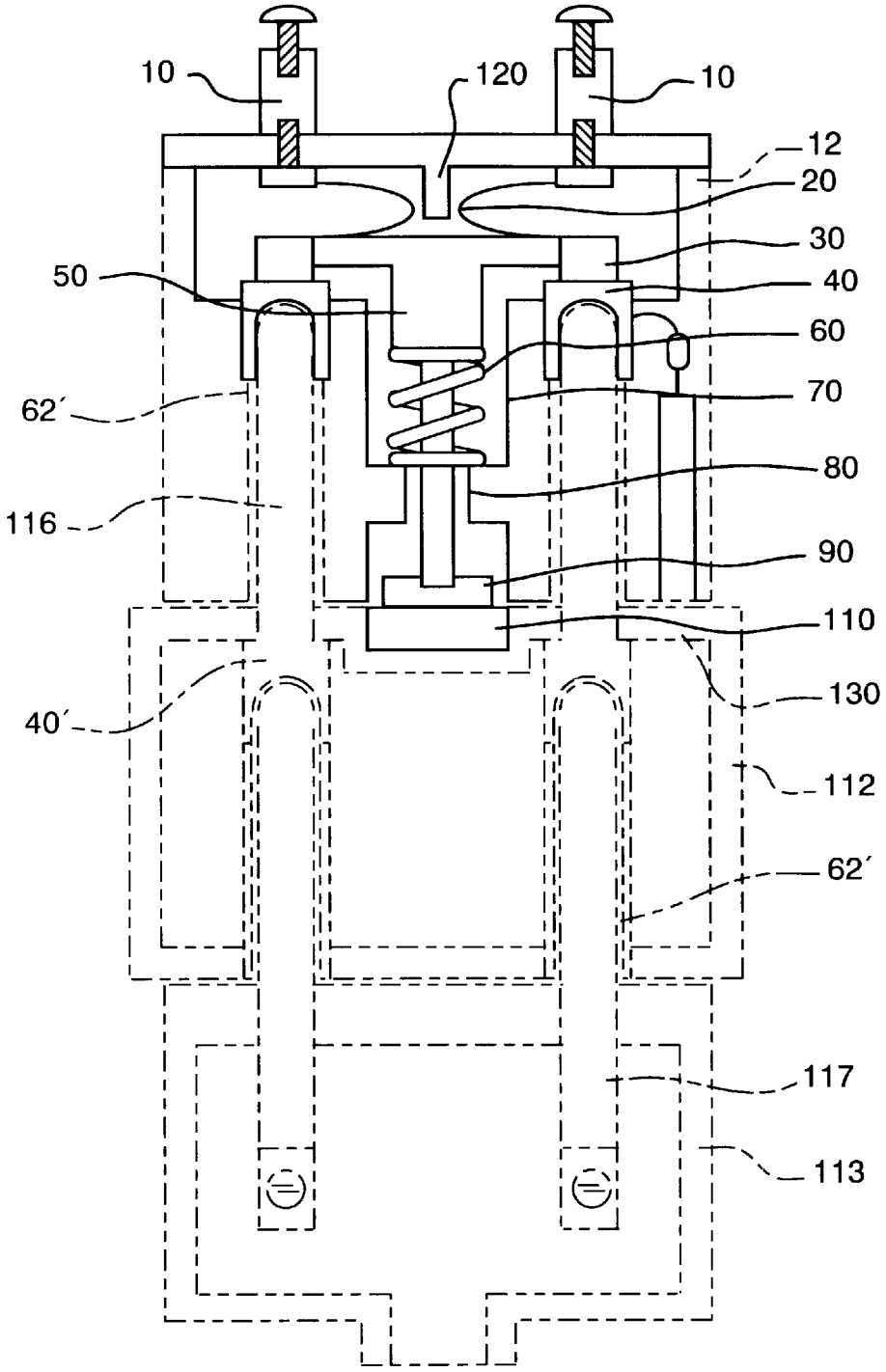
FIG. 3 is a side cutaway schematic view of an alternative embodiment of the invention with the adapter, for use with a standard plug.

As shown in FIG. 3, an alternative embodiment of outlet plug 112 enables the invention to be used with the standard outlet plug 113 that is attached to the device that is to be power by outlet receptacle 12. In this embodiment, outlet plug 112 is fitted with another set of electrical connection ports 40' and openings 62' so that a standard outlet plug 113 having pins 117 can be inserted into outlet plug 112. In this fashion, the cord and plug that comes with the device that requires electrical power does not need to be changed.

Figure 4:
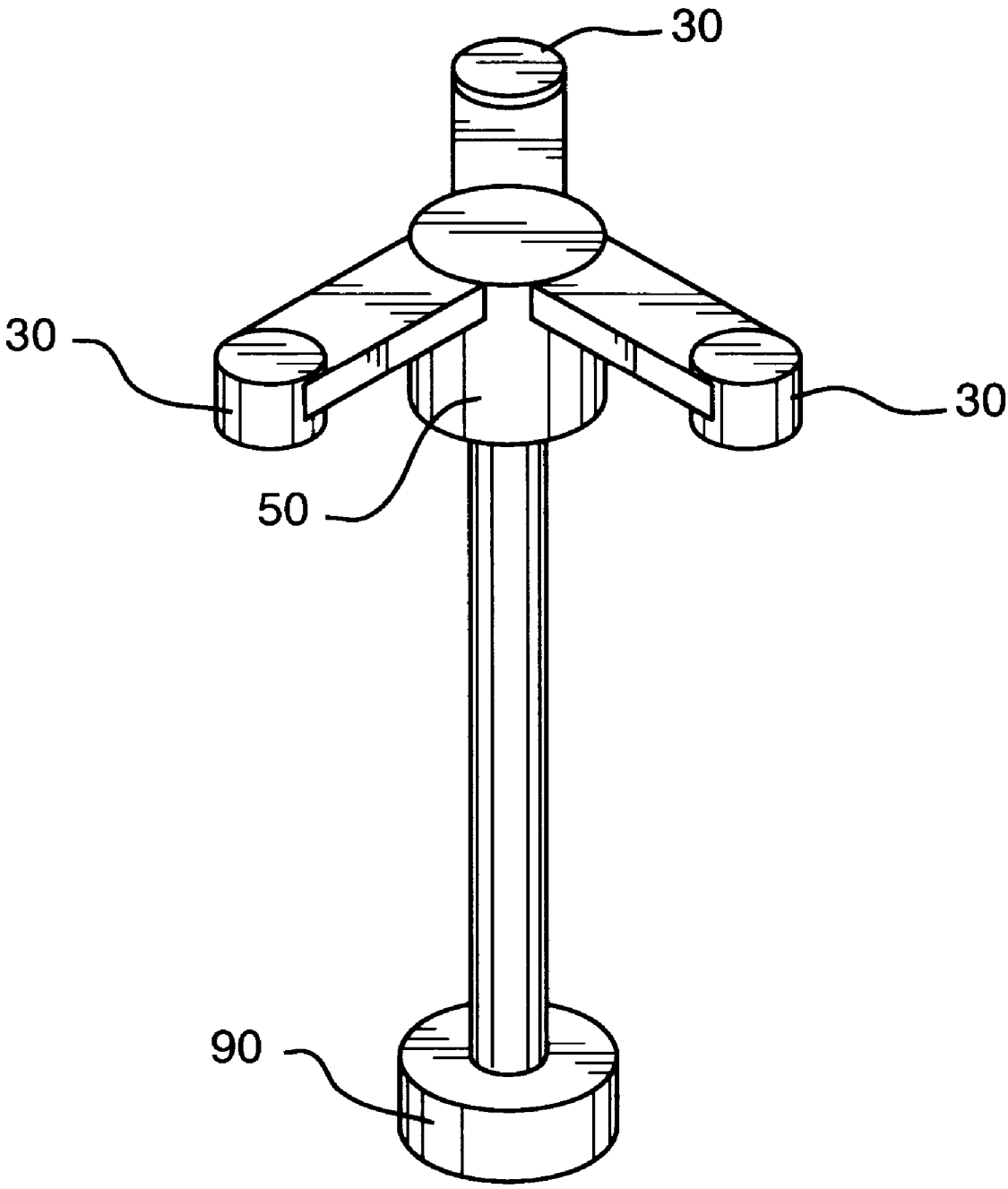
FIG. 4 is an isometric schematic view of an alternative embodiment for use with a three-phase receptacle.

FIG. 4 shows an alternative embodiment wherein piston 50 has three contacts 30 for use with a three-phase safety receptacle with all three connected to piston 50.

Figure 5:
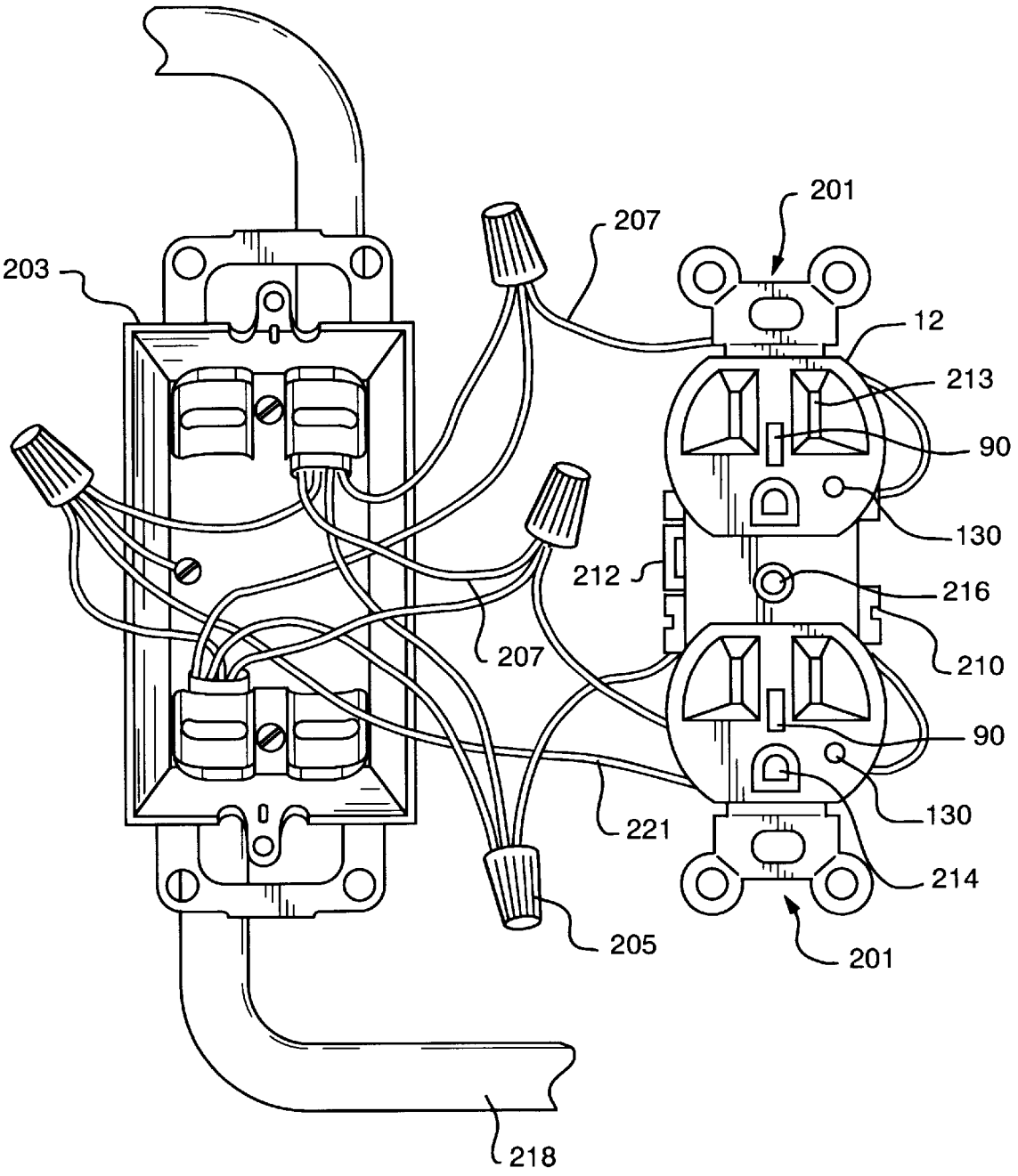
FIG. 5 is a front view of the preferred embodiment that is to be mounted in a standard outlet box in accordance with the invention.

FIG. 5 shows the invention mounted in a standard wall mounted outlet box 203. Box 203 is made electrically active via feeds 218. Outlet receptacle 12 appears virtually the same from the outside since the invention will easily fit within the same approximate dimensions and shape of a standard outlet receptacle. Outlet receptacle 12 is outfitted with attachment lugs 201 so that it can attach to outlet box 203 using screws. An outlet cover plate (not shown) can be attached to outlet receptacle 12 via threaded opening 216 as in the standard outlet receptacle. Outlet receptacle 12 is shown wired in a typical configuration used in a residence. Feeds 207 are attached to outlet receptacle 12 using connectors 210. Lug 212 enables both receptacles to be wired with a single wire. If lug 212 is removed, then each outlet is wired separately as shown on the right hand side of outlet receptacle 12. Indicator light 130 is shown positioned to the right of ground connection 214. However, this position is not critical and could be placed anywhere on the front of each outlet. Metallic base 90 is shown positioned between sockets 213. Again, this is not critical and base 90 could be similarly positioned anywhere on the front of each outlet. As noted above, magnet 110 could be substituted for base 90. Feeds 207 are held together using wire nuts 205 as is customary in the art.

While there has been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A safety apparatus for selectively placing an electric outlet either in an active or an inactive state, said apparatus comprising:

an outlet receptacle having at least two electrical connection ports and having at least two electrical feeds with each one of the electrical connection ports corresponding to one of the electrical feeds and with at least one of the feeds being designated as "hot", wherein the feeds connect said outlet receptacle to an electrical system;

a slideable piston mounted within said outlet receptacle, said piston having a contact end and an activation end;

at least one contact attached to the contact end of said slideable piston and in electrical communication with hot feed;

a compression spring positioned around said slideable piston for biasing said piston;

an outlet plug having a mounting surface with at least two electrical pins protruding substantially perpendicular thereto, such that the electrical pins correspond to the electrical connection ports of said outlet receptacle are aligned so that said outlet plug can be inserted into said outlet receptacle;

a magnet member and a matching member capable of being attracted by said magnet, therein defining a single matched pair, wherein one member of said matched pair is mounted on the mounting surface of said outlet plug and the other member of said matched pair is mounted on the activation end of said slideable piston, and being aligned such that when said outlet plug is inserted into said outlet receptacle, said matched pair are immediately adjacent to one another;

wherein when said outlet plug is out of said receptacle, said spring biases said slideable piston causing the at least one contact to be disengaged from its corresponding electrical connection port, therein providing the inactive state such that at least the hot feed of said outlet receptacle is isolated from the corresponding electrical connection port, so that said outlet receptacle is unable to transmit an electrical current; and wherein when said plug is inserted into said receptacle, magnetically attracted toward one another resulting in said slideable piston sliding to cause said contact to releasable connect to its corresponding electrical connection port, therein providing the active state, so that said outlet receptacle is able to transmit an electrical current.

2. The safety apparatus of claim 1 wherein said magnet is mounted on said outlet plug and said other member of said single matched pair is mounted on the activation end of said slideable piston.

3. The safety apparatus of claim 1 wherein said magnet is mounted on said slideable piston and said other member of said single matched pair is mounted on said outlet plug.

4. The safety apparatus of claim 1 wherein said receptacle is a double receptacle.

5. The safety apparatus of claim 1 wherein said outlet plug further comprises an outlet surface having at least two electrical connection ports with each of the electrical connection ports electrically connected to one of the outlet pins of said outlet plug such that a standard outlet plug may be connected to said outlet receptacle via said outlet plug, thereby eliminating the need to change the standard outlet plug in order to utilize the safety advantages provided by said apparatus.

6. The safety apparatus of claim 1 wherein said outlet receptacle further comprises two contacts attached to said slideable piston with each of said contacts having a corresponding feed and an electrical connection port.

7. The safety apparatus of claim 1 wherein outlet receptacle further comprises three contacts attached to said slideable piston with each of said contacts having a corresponding feed and an electrical connection port.

8. The safety apparatus of claim 1 wherein said outlet receptacle is substantially the same size as a standard outlet receptacle wherein said outlet receptacle can be inserted within a standard outlet box and electrically connected thereto.

9. The safety apparatus of claim 1 further comprising an indicator light that is electrically connected to at least one electrical connection port of said outlet such that said indicator light visually indicates whether said outlet is active by being illuminated or whether said outlet is inactive by not being lit.

10. The safety apparatus of claim 9 wherein said indicator light is a neon light.

* * * * *